US007305789B2

(12) United States Patent
Frost

(10) Patent No.: US 7,305,789 B2
(45) Date of Patent: Dec. 11, 2007

(54) REVERSIBLE WEAPON TELESCOPE MOUNT

(76) Inventor: Michael Frost, 250 Via San Miguel, Liberty, KY (US) 42539

( * ) Notice: Subject to any disclaimer, the term of this patent is extended or adjusted under 35 U.S.C. 154(b) by 183 days.

(21) Appl. No.: 11/340,036

(22) Filed: Jan. 26, 2006

(65) Prior Publication Data

US 2007/0169393 A1 Jul. 26, 2007

(51) Int. Cl.
*F41G 1/16* (2006.01)

(52) U.S. Cl. ..... 42/125; 42/124; 42/126; 42/127; 42/128

(58) Field of Classification Search ..... 42/85, 42/90, 124–128
See application file for complete search history.

(56) References Cited

U.S. PATENT DOCUMENTS 5,896,850 A * 4/1999 Sullivan, Jr. ..... 124/74
5,941,489 A * 8/1999 Fanelli et al. ..... 248/298.1
6,449,893 B2 * 9/2002 Spinner ..... 42/127
6,931,779 B1 * 8/2005 Galuppo, Jr. ..... 42/127
2004/0016169 A1 * 1/2004 Poff, Jr. ..... 42/124

* cited by examiner

*Primary Examiner*—Troy Chambers
(74) *Attorney, Agent, or Firm*—Larson & Larson, PA; Herbert W. Larson

(57) ABSTRACT

A low profile, reversible weapon telescope mount is provided. The mount has a longitudinal planar top support having a series of ridges and recesses disposed thereupon in an alternating and parallel orientation to that of a central axis of the support. Attached to opposed peripheral side edges of the support are four downwardly depending legs. The support and legs form a channel of the scope mount that surrounds a top end of a weapon receiver, such as a rifle, such that a bottom surface of the top planar support rests upon a top surface of the receiver. Each leg has a movable guide finger supported in a vertical channel formed in each leg. Each guide finger has an inwardly extending ledge member for grabbing outwardly extending flanges of the rifle receiver. The finger is guided up and down by an pin inserted through the leg and finger when a screw, acting upon the finger is tightened or loosened. The mount can be reversed so that its front end is closer to the head of the user of the weapon while still permitting a telescope to be mounted thereupon.

17 Claims, 4 Drawing Sheets

10
74
8
22
22
24
24
18
16
14
14
12
7
7
56
56
8

76
56
44
66

74
68
74
14
14
76
56
56
80
80
78
76

74
68
40
14
44
62
48
66
72
70
54
64
56
52
50
76
60
82
58

REVERSIBLE WEAPON TELESCOPE MOUNT

BACKGROUND OF THE INVENTION

1. Field of Invention

The present invention relates to weapon telescope mounts. More particularly, this invention relates to a reversible weapon telescope mount for use with a variety of different models of rifles, submachine guns and machine guns and whose use does not necessitate the employment of other attachment elements.

2. Description of the Prior Art

Weapon telescope mounts, and those specifically used for rifles, submachine guns and machine guns, are well known in the prior art. Hunters, marksman as well as soldiers throughout the world use telescopes ("scopes") regularly as part of their rifle, submachine gun or machine gun system. A weapon telescope assists a shooter by zeroing in the aim of the weapon on a target which is at a distance outside the operable, visual range of the human eye. Usually, a set of cross hairs or an electronic pin-pointing mechanism is enclosed within the telescope which allows the shooter to place a bullet on the exact spot of the target that he desires. Ideally, the cross-hairs of a scope indicate where the bullet will land. Hence, it is important that the scope be stably mounted to the gun. Weapon telescope mounts can accomplish this task.

There are a bevy of different styles of scope mounts known in the prior art. The weapon to be used typically dictates the style of scope mount that must be employed. Nowhere in the prior art does a single universal scope mount exist. This is due to the multitude of different weapons that exist. All of these different weapons have alternating styles of configuration. The only thing common to most weapon scope mounts is that the mount typically attaches to a top portion of a weapon receiver and all mounts support the scope in a rigid manner in axial alignment with an open end of the weapon barrel. The weapon receiver is that portion of a gun that receives and retains a bullet for firing by the trigger mechanism through the barrel.

Often, a particular manufacturer will construct many different models of rifles, submachine guns and machine guns. These different models, however, may have similar configurations for certain parts of the gun, such as, the receiver. This permits the manufacturer to offer different calibers of weapons having different features, but which are all designed around a common configuration. For instance, a manufacturer may offer a semi-automatic weapon in a particular caliber, for instance 5.56 mm NATO, available for use by the general public, a fully automatic weapon of the same caliber for use by law enforcement and the military and a fully automatic weapon, but belt fed instead of by a magazine, for use solely by the military. An example of such manufacturer is Heckler & Koch™, which offers the HK93, a semi-automatic assault rifle, the HK53, a fully automatic submachine gun and the HK33, a belt feed submachine gun. All three of these weapons utilize the same caliber bullet, namely 5.56 mm NATO, have the same receiver, but utilize different lowers. The different configured lowers dictate at what rate of fire the weapon can shoot and the type of magazine, drum or belt that attaches thereto. However, the receiver for each gun is the same. Accordingly, one particular scope mount can attach to all three guns. The above exampled manufacturer even may use receivers for other guns that have similar features, allowing the same scope mount to attach thereto, even though the caliber of bullet may be different, for example a 9 mm round.

It is unlikely that a scope mount for the above mentioned manufacturer that attaches to these specific guns will attach to any other gun. Hence, the lack of any universal scope mount existing in the prior art. Instead, what is common in the art is that specific scope mounts are designed, manufactured and offered for specific guns or a specific manufacturer.

Scope mounts of the prior art, regardless of their intended mount, have deficiencies that need to be overcome. The most common difficultly relates to the height of the scope mount. It is first understood that the center of gravity, the compactness of the gun and its ability to be used in confined spaces are all factors leading to their use and purchase and ultimately their functionality. Nowhere is this more important than in the military arena.

Most modern wars are fought in the very confined spaces of an urban environment, otherwise known as street to street. However, the need for telescopes still exists and is, in fact, on the rise due to the effective range and accuracy of modern weapons. Even though a soldier may be fighting in a street battle, he may be required to eliminate a target at a great distance. The scope assists the soldier in making these long distance shots. Further, the soldier desires to eliminate his target while minimizing civilian causalities. This is done by firing the least amount of rounds possible to affect target elimination but reduce stray fire. Accordingly, the soldier again needs a scope to accurately fire as few rounds as possible.

Further, a soldier does not want to make himself visible or give his position away (especially in case of a sniper), nor does he want to make his gun bulky or awkward to handle. Therefore, a need exists for the scope to be mounted in a manner which does not render the gun awkward, bulky or which significantly changes the center of gravity of the weapon affecting his ability to shoot accurately. This need can be fulfilled by choosing a scope mount that will not introduce these deficiencies into his weapon system. Accordingly, he does not want a scope mount that has a high profile, a very typical problem in the prior art. Nowhere is this greater a problem than with scope mounts that are known for use with Heckler and Koch™ rifles, submachine guns and machine guns, and in particular, the HK31, 33, 51, 53, 91, 93, 94, the MP5 and the G3.

Scope mounts of the prior art used with the aforementioned guns are made from a large and high profile metal frame. An example of such a mount is that which is manufactured by the A.R.M.S.™ company. This device employs a tall framework of legs that clamp to side flanges of the gun by use of a pressure spring and handle mechanism. It is intended to be a quick release device wherein precise accuracy is not a factor (clearly not suitable for a sniper). It is understood that the constant removal and reattachment of the scope mount changes the accuracy of the telescope it supports. Accordingly, this device is useful to enthusiasts who have the leisure time to slowly unpack their weapon at a firing range and attach their scope and methodically practice their aim on a paper target until they zero their scope "back-in". These high profile devices are not likely to adversely affect shooters whose every shot may be the difference in life and death (as with a soldier). High profile devices greatly alter the center of gravity of the weapon and make the weapon more awkward to handle due to the displacing of the weight of the scope to an exaggerated height above the receiver of the weapon. Further, these prior art high profile devices interfere with the OEM sighting device on the gun. Accordingly, if a shooter wishes to use the OEM sighting mechanism of the gun, he must remove the mount along with the telescope. Removing just the scope leaves the mount behind which blocks the OEM gun sight.

However, these high profile mount devices do allow a shooter to quickly remove the scope in its entirety and return the gun to its natural, stripped-down state, a condition that many leisurely users find enticing. However, soldiers preparing for battle or a sniper headed out on a multi-day mission are not concerned with quickly mounting their scopes. Instead, they are concerned with accuracy of each and every shot. Further, soldiers are not concerned with the looks of a weapon system, but instead its functionality. And the high profile, quick releasable scope mounts lack the functional ability that the soldier needs. Soldiers require that their weapon system have a low profile and have a weighted balance that makes the weapon comfortable to hold and be generally easy to handle in a fire fight. This dictates a need for a low profile telescope mount. And nowhere is this more important than on Heckler & Koch™ weapon models HK31, 33, 51, 53, 91, 93, 94, the MP5 and the G3.

SUMMARY OF THE INVENTION

I have invented an improved weapon telescope mount for use with specific weapons. My mount is reversible so that it can be employed with a variety of different models of Heckler & Koch rifles, submachine guns and machine guns. In particular, my mount can be used with Heckler & Koch™ models HK31, 33, 51, 53, 91, 93, 94, the MP5 and the G3.

My telescope mount has a longitudinal planar top support and four downwardly depending legs. The top support has a series of parallel ridges and recess alternately disposed orthogonally to an axis of said longitudinal support for receiving and retaining the scope. Each leg has an inwardly extending finger for clamping up and against side flanges protruding from the gun and disposed along opposed side portions of the receiver of said gun. Each finger attaches to a flange when a screw or bolt for each leg is tightened from a top portion of said leg.

Employment of the novel telescope mount of the present invention provides for a low profile mount. In particular, a bottom surface of the mount top support rests along a top surface of the gun receiver. Accordingly, the telescope mount of the present invention becomes a part of the gun to which it is attached. Removal of the telescope does not require removal of the novel mount of the invention. When the telescope is removed, the mount remains on the gun and does not affect the firing of the gun or block the integral OEM sighting device of the gun. Accordingly, a shooter can remove his scope, stow it away and continue to fire his weapon without removing the mount and without his OEM sighting device being interfered. My scope mount is not meant to be a quick release mechanism, but instead a fixed and/or integral part of the gun.

BRIEF DESCRIPTION OF THE DRAWINGS

The detailed description of the invention, contained herein below, may be better understood when accompanied by a brief description of the drawings, wherein.

DETAILED DESCRIPTION OF THE PREFERRED EMBODIMENT

Figure 1:
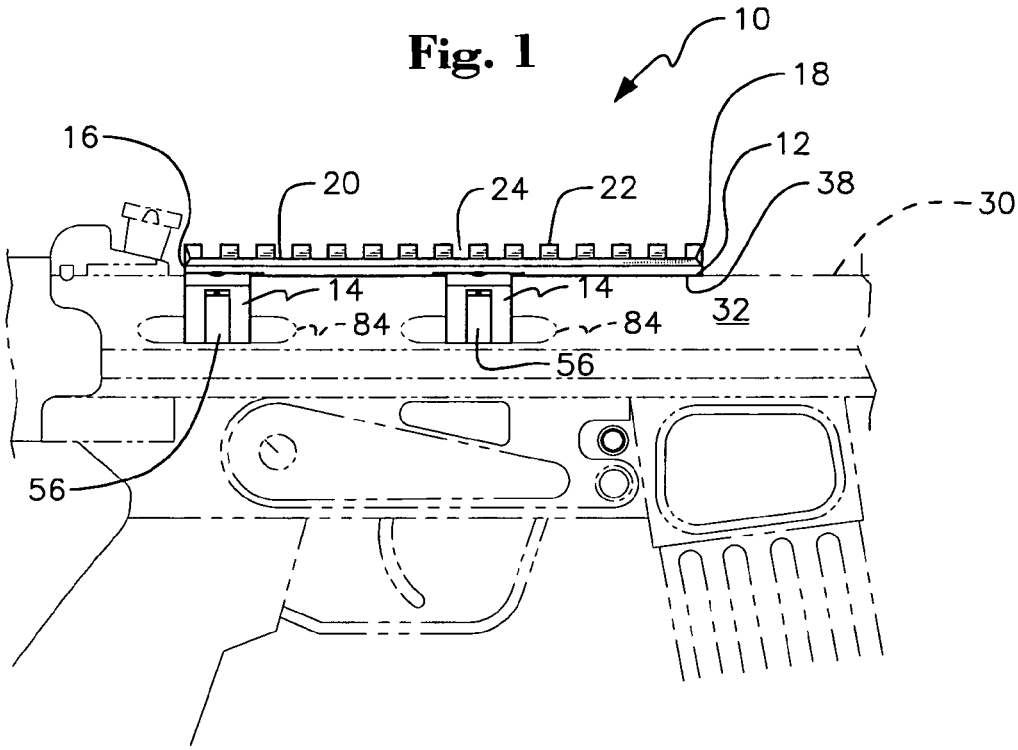
FIG. 1 is a side plan view of a reversible weapon scope mount of the present invention.
Figure 2:
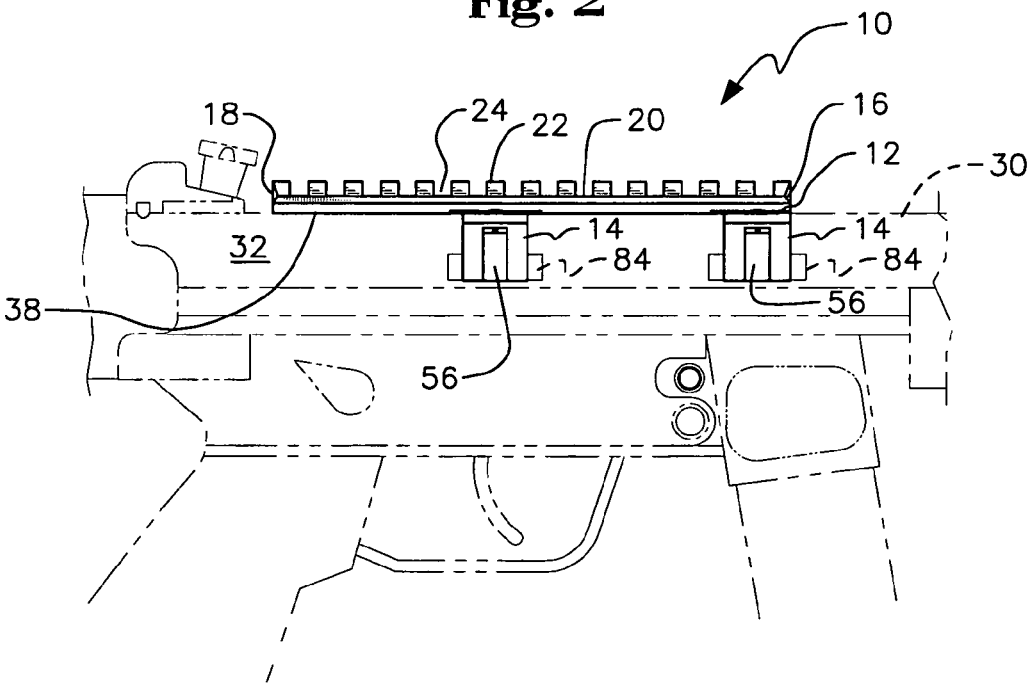
FIG. 2 is a side plan view of the reversible weapon scope mount of the present invention employed in a direction opposite to that as shown in FIG. 1.

Referring to FIGS. 1 and 2, a reversible weapon telescope mount 10 (hereinafter scope mount 10) of the present invention is shown. As depicted in FIGS. 1 and 2, scope mount 10 is reversible to accommodate the employment of scope mount 10 to different weapons, of which specific models will be discussed hereinafter.

Figure 3:
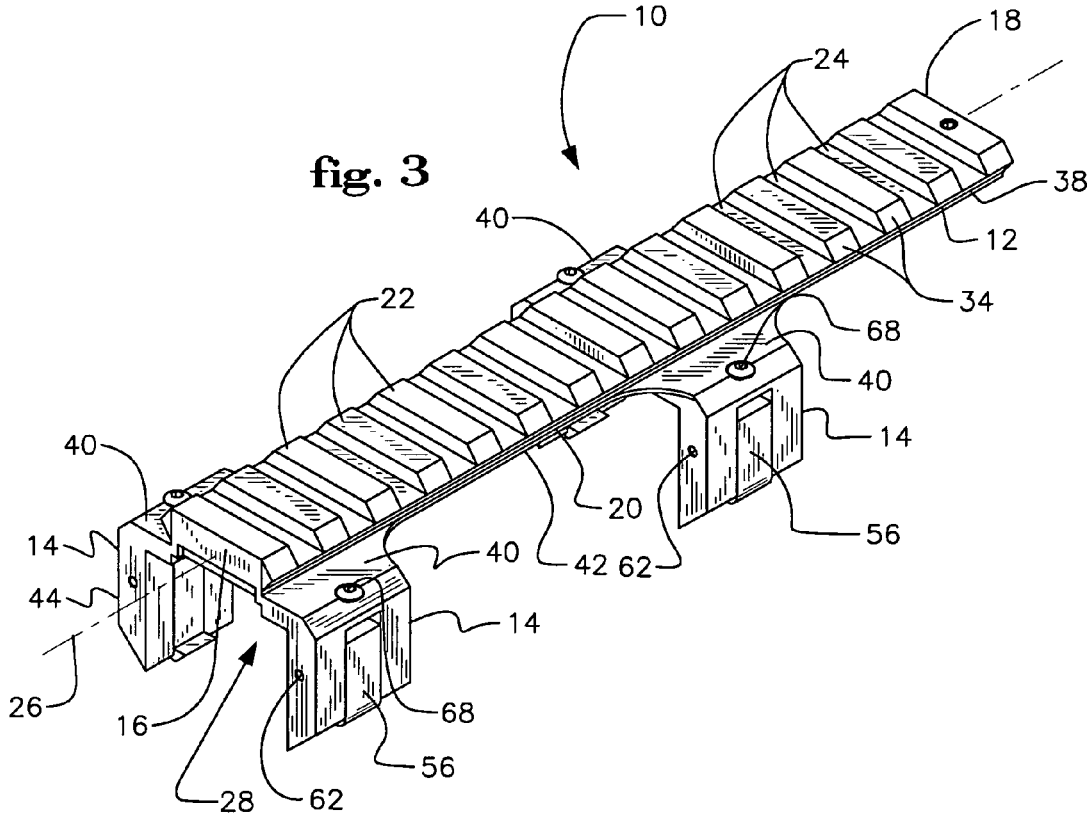
FIG. 3 is a perspective view of the novel reversible scope mount.

With continuing reference to FIGS. 1 and 2, and with further reference to FIG. 3, it is shown that scope mount 10 includes a top planar support 12 and a set of downwardly depending legs 14. In the preferred embodiment, which is depicted in all of the Figs., scope mount 10 has four legs 14. However, nothing herein limits the use of less than or more than four legs 14. The number of legs 14 employed is dependent on the weapon on which scope mount 10 is to be used. As will be discussed hereinafter, the present invention, in its preferred embodiment, is intended to be used with particular models of weapons manufactured by a particular company. Therefore, in the preferred embodiment four legs 14 are used. However, it is understood that if the present scope mount 10 attaches in the same manner as described herein, but to a different weapon not mentioned herein, it was intended by the Applicant to affect such engagement.

Further to FIGS. 1-3, top planar support 12 has a back and front end 16 and 18, respectively, and a middle portion 20. Two of the four legs 14 (the back legs) are disposed proximal to back end 16 while the other two legs 14 (the front legs) are disposed slightly forward of middle portion 20 such that the front legs are about a quarter way between middle portion 20 and front end 18, but closer to middle portion 20.

As further shown in FIGS. 1-3, scope mount 10 has a plurality of ridges 22 and recesses 24, alternately disposed in a parallel orientation and positioned orthogonally to a central axis 26 of scope mount 10. Each ridge 22 has a box-like rectangular shape and has a width generally equal to a width of each successive recess 24. Further, with additional reference to FIGS. 4 and 5, each ridge 22 has a triangular-shaped member 34 attached to opposing ends thereof. Triangular-shaped members 34 assist in attaching a telescope 36 to scope mount 10 (see FIGS. 10 and 11).

Figure 4:
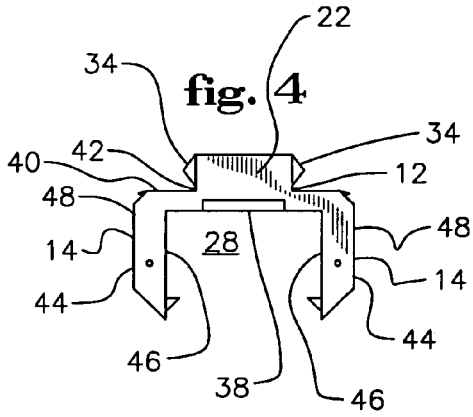
FIG. 4 is a back side view of the reversible scope mount.
Figure 5:
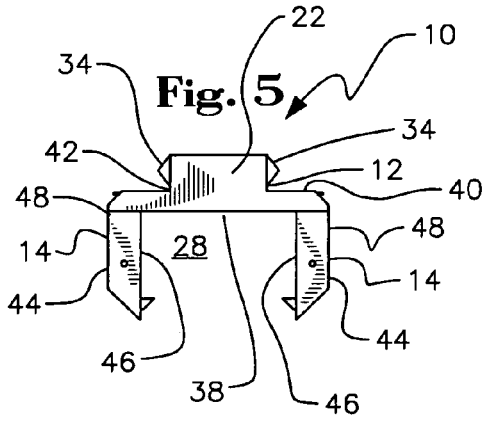
FIG. 5 is a front side view thereof.
Figure 6:
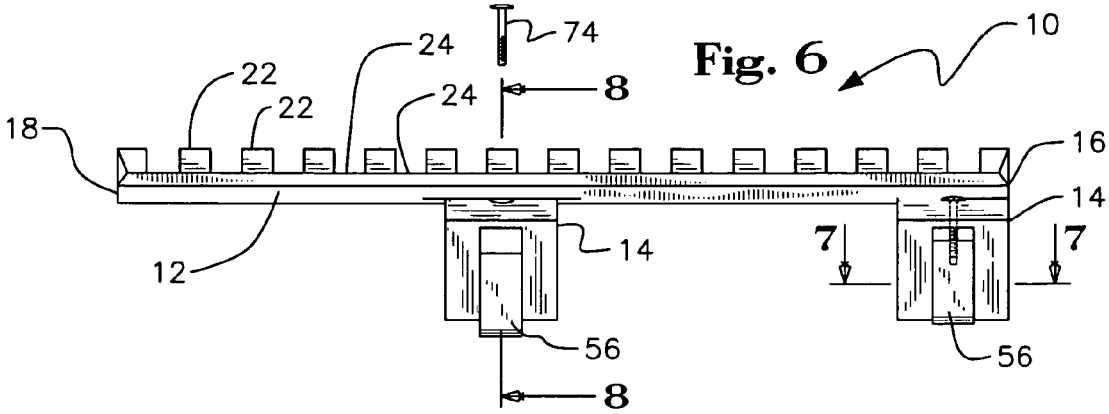
FIG. 6 is a side plan view of the reversible scope mount of the present invention illustrated when not employed on a weapon.
Figure 7:
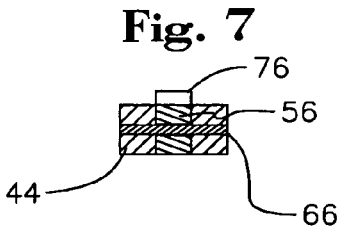
FIG. 7 is a cross-sectional view of the invention taken along lines 7-7 of FIG. 6.

With reference to FIGS. 4 and 5, it is shown that a channel 28 is formed underneath top planar support 12 and in between legs 14. Referring to FIGS. 1 and 2, it is shown that channel 28 fits over a weapon receiver 32 such that a bottom surface 38 of top planar support 12 rests upon a top portion 30 of receiver 32.

With reference now to FIG. 3, it can be seen that each leg 14 includes an outwardly extending top portion 40 that is integrally attached along a peripheral edge 42 to top planar support 12. Peripheral edge 42 runs along both side edges of top planar support 12 in a parallel orientation to axis 26. Each leg 14 also includes a downwardly extending portion 44 attached to a distal end of outwardly extending top portion 40 such that portions 40 and 44 of each leg 14 are disposed at a 90° angle to one another (as seen in FIGS. 4 and 5). Each leg 14 also has an inner surface and outer surface 46 and 48, respectively, of the downwardly extending portion 44.

Figure 9:
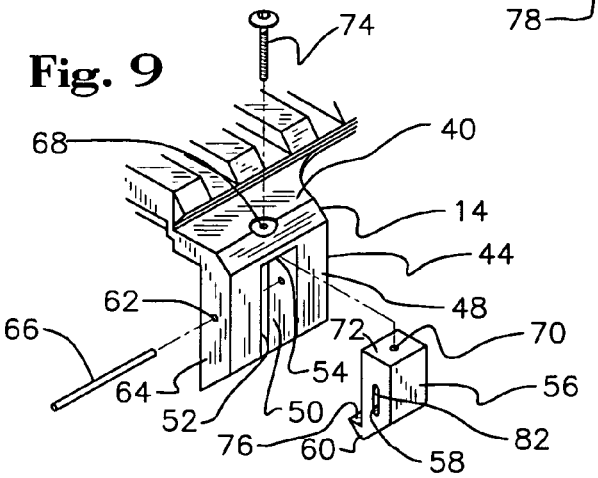
FIG. 9 is a partial perspective view of the reversible weapon scope mount of the present invention illustrating, in detail, one of its leg members.

Referring to FIG. 9, leg 14 further includes a guide channel 50 formed in outer surface 48 of portion 44. As shown, guide channel 50 has an open bottom end 52 and a closed top end 54. Each guide channel 50 receives a movable guided finger 56 whose shape conforms generally to that of the guide channel 50 formed in each leg 14. An oblong-shaped cavity 58 is formed in guide finger 56 oriented in a like horizontal axial direction of guide finger 56. Cavity 58 is formed such that it is open on opposed side walls 60 of guide finger 56. A horizontal bore 62 is formed through opposed side walls 64 of downwardly extending portion 44 of leg 14. A pin 66 is inserted in bore 62 and through leg opposed side walls 64 and finger guide cavity 58. A first vertical bore 68 is formed in outwardly top portion 40 of leg 14 and is in axial alignment with a second vertical bore 70 formed in a top wall 72 of finger guide 56. When finger guide 56 is placed in guide channel 50, a screw 74 is inserted in first vertical bore 68 for engaging second vertical bore 70. Both first and second vertical bores, 68 and 70 respectively, have threads positioned along inner surfaces thereof for receiving screw 74, having reciprocal threads thereon.

With continuing reference to FIG. 9, it can now be appreciated that guide finger 56 moves up and down in guide channel 50 when pin 66 is inserted through horizontal bore 62 of leg 14 which further intersects cavity 58 of guide finger 56 when screw 74 is tightened or loosened. With pin 66 inserted therein, finger guide 56 is prohibited from falling out of guide channel 50 even if screw 74 is removed. Further, the upper and lower limits of cavity 58 represent the extent in which guide finger 56 can move upwards and downwards. In other words, pin 66 rests upon an upper limit 82 of cavity 58 when screw 74 is removed or loosened and is juxtaposed upon a lower limit of cavity 58 when screw 74 is tightened. These two contrasting positions affected by pin 66 can be seen in FIGS. 8 and 9.

Figure 8:
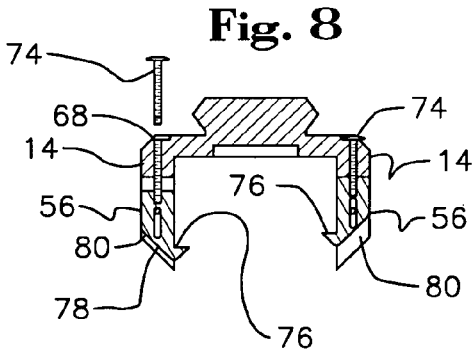
FIG. 8 is another cross-sectional view of the present invention, but taken along lines 8-8 of FIG. 6.

With reference to FIGS. 8 and 9, it is shown that legs 14 additionally include an inwardly extending ledge 76 positioned at a bottom end 78 of guide finger 56. In the preferred embodiment, ledge 76 is integrally attached to guide finger 56. However, nothing herein limits ledge 76 from being a separable, attachable element. Guide finger 56 also has an inwardly slopping wall 80 of the bottom end 78 which reaches a lower limit point and which, in coincidence with ledge 76, gives bottom end 78 of guide finger 56 a triangular-like shape.

As shown in FIGS. 1, 2, 10 and 11, scope mount 10 rests upon top portion 30 of rifle receiver 32. Accordingly, scope mount 10 of the present invention is a low profile device that provides many advantages over prior art scope mounts. As discussed before, most scope mounts of the prior art sit high upon a rifle receiver such that any bottom surface of an upper support does not rest upon the top surface of the weapon receiver, such as the novel scope mount 10 of the present invention. Scope mount 10 of the present invention is also reversible as shown therein, which permits scope mount 10 to be used with a bevy of different weapons.

With continuing reference to FIGS. 1-3, scope mount 10 attaches to a weapon by channel 28 surrounding receiver 32. Legs 14 are aligned on top of outwardly extending flanges 84 of receiver 32. Ledges 76 of each guide finger are positioned below each respective flange 84 by loosening each screw 74. In the preferred embodiment, four legs 14 are employed which align with four reciprocal flanges 84. Once scope mount 10 is resting upon receiver 32, each screw 74 is tightened such that each ledge 76 of each guide finger 56 is pulled-up underneath flange 84 which in turn pulls scope mount 10 firmly against receiver 32 at the top portion 30 and along opposing sides of receiver 32 where inner surfaces 46 of downwardly extending portions 44 of legs 14 are juxtaposedly positioned.

Figure 10:
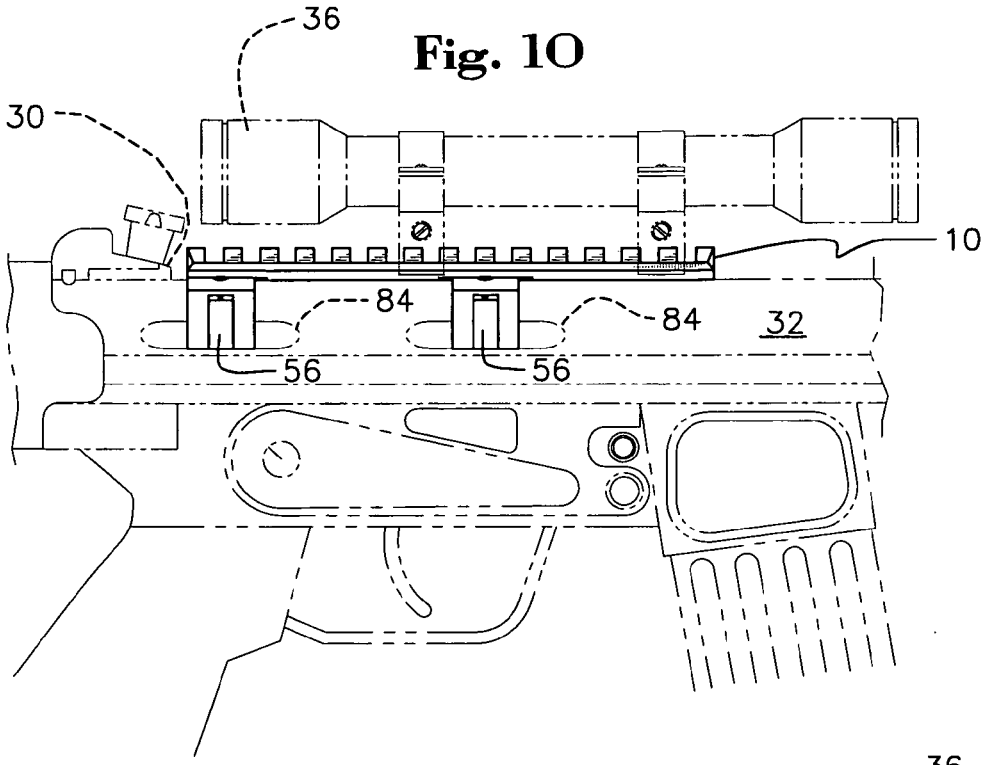
FIG. 10 is a side plan view of the scope mount of the present invention illustrated when mounted on a weapon and having a scope attached thereto.
Figure 11:
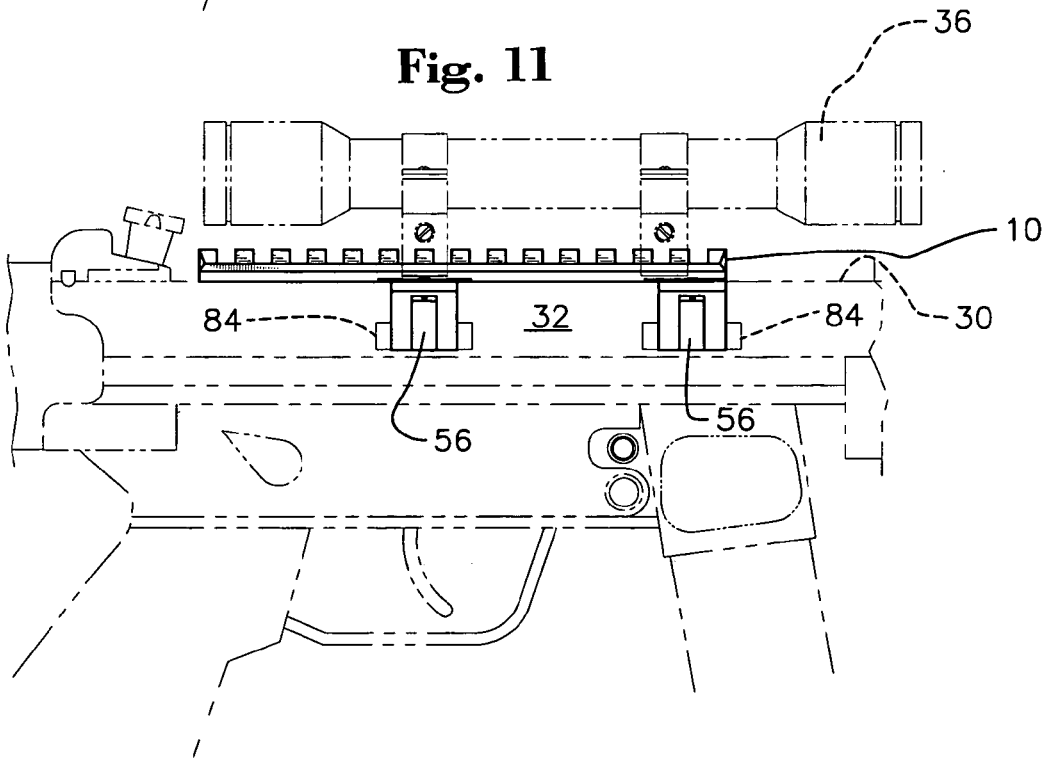
FIG. 11 is another side plan view of the scope mount of the present invention illustrated to be mounted on a weapon, but of a different type, and therefore reversed, and having a scope mounted thereto.

The scope mount 10 of the present invention can be used with any weapon requiring a telescope for providing accurate placement of a shot or shots fired. The configuration of scope mount 10 dictates that the weapon employ the outwardly extending flanges 84 so that scope mount 10 can be attached thereto. As stated before, four legs 14 are employed in a preferred embodiment of the present invention. This is because scope mount 10 is intended to be used with particular Heckler & Koch™ rifles, submachine guns and machine guns. In particular, scope mount 10 mounts in a forward position on models HK 31, 33, 51, 53, 91 and 93 and the G3 models as shown in FIGS. 1 and 10. In its reversed employment (such that front end 18 is closer to the OEM site device of the weapon) scope mount 10 mounts on any HK MP5 model gun and the HK 94.

Equivalent elements can be substituted for ones set forth herein to achieve the same results in the same way and in the same manner.

Having thus described the present invention in the detailed description of the preferred embodiment, what is desired to be obtained in Letters Patent is:

1. A reversible weapon telescope mount for attaching to a weapon and supporting a telescopic device, the weapon having a receiver and a top surface thereof and a plurality of flanges protruding from opposing side surfaces of the receiver, the reversible weapon telescope mount comprising:

a) a longitudinal top planar support having a top and bottom surface, a front and back end and opposing longitudinal peripheral edges;

b) a plurality of downwardly depending legs attached to the opposing longitudinal peripheral edges of the top planar support, each leg having an outwardly extending top portion and a downwardly depending extension positioned at a 90° angle to one another, each leg also having a vertically positioned bore formed through the outwardly extending top portion;

c) a guide channel formed in each of the downwardly depending extensions of the plurality of downwardly depending legs, each guide channel having an open bottom end and a closed top end;

d) a guide finger vertically positioned within each guide channel, each guide finger having an oblong-shaped cavity formed therethrough and open on opposing side walls along a vertical axis of the guide finger, a vertical bore formed through a top wall of the guide finger and extending thereinto along the vertical axis, each guide finger also having an inwardly extending ledge along a bottom end thereof, the vertical bore of the guide finger in axial alignment with the vertically positioned bore of the leg when the guide finger is inserted into the guide channel;

e) a horizontally disposed bore formed through opposing side walls of the downwardly depending extension of each leg;

f) a pin inserted in the horizontally disposed bore and the guide finger cavity for permitting the guide finger to move up and down to an upper and lower limit; and g) a screw inserted into the vertically positioned bore of each leg for engaging the vertical bore of the guide finger and causing the guide finger to move up and down within the guide channel, the inwardly extending ledge of each guide finger engaging a bottom lip of the weapon receiver flange and the bottom surface of the top planar support resting against the receiver top surface when the screws are tightened.

2. The reversible weapon telescope mount of claim 1, further comprising a plurality of ridges and recess disposed upon the top planar support top surface, orthogonally oriented in relation to the opposing longitudinal peripheral edges.

3. The reversible weapon telescope mount of claim 2, wherein the plurality of ridges and recess alternate along the top planar support top surface.

4. The reversible weapon telescope mount of claim 1, wherein four legs are employed.

5. The reversible weapon telescope mount of claim 4, wherein the weapon employs four flanges.

6. The reversible weapon telescope mount of claim 4, wherein the four legs comprise a pair of back legs disposed at the top planar support back end and a pair of front legs disposed forward of a middle portion of the top planar support.

7. The reversible weapon telescope mount of claim 1, wherein the top planar support back end is proximal and the top planar support front end is distal to a back end of the weapon when the mount is attached to the weapon.

8. The reversible weapon telescope mount of claim 1, wherein the top planar support back end is distal and the top planar support front end is proximal to a back end of the weapon when the mount is attached to the weapon.

9. The reversible weapon telescope mount of claim 1, wherein the weapon is chosen from the group consisting of a rifle, submachine gun and machine gun.

10. The reversible weapon telescope mount of claim 9, wherein the weapon is chosen from the group consisting of Heckler and Koch™ models HK31, HK33, HK51, HK53, HK91, HK93, HK94, MP5 and G3.

11. A rifle telescope mounting device for attaching to a receiver of a rifle and supporting a telescopic viewing device, the rifle having at least four flanges protruding from opposing side surfaces of the receiver, and the rifle receiver having a top surface for supporting the rifle telescope mounting device directly thereupon, the rifle telescope mounting device comprising:

a) a longitudinal top planar support and four downwardly depending legs, the top planar support and four legs forming a channel underneath the top planar support and between the four legs, the rifle receiver positioned within the channel such that a bottom surface of the top planar support rests directly upon the top surface of the receiver and inner surfaces of the four downwardly depending legs are positioned juxtaposed the four flanges of the rifle receiver opposing side surfaces;

b) each of the four legs having a guide channel formed along an outer surface of each leg;

c) four guide fingers, one each inserted within each guide channel and each held in place by a pin inserted through a horizontally formed bore through each leg and each guide finger;

d) a vertically formed bore in a top portion of each leg for receiving a screw for engaging a reciprocal axial bore form in each guide finger, the screw adjusting an upper and lower limit position of each guide finger; and e) an inwardly extending ledge positioned at a bottom portion of each guide finger, each ledge contacting a lower lip of the receiver flanges when the screws are tightened and the guide fingers reach the upper limit.

12. The rifle telescope mounting device of claim 11, further comprising opposing longitudinal peripheral edges of the top planar support.

13. The rifle telescope mounting device of claim 12, wherein the four downwardly depending legs are attached to the longitudinal peripheral edges of the top planar support.

14. The rifle telescope mounting device of claim 12, further comprising a plurality of ridges and recesses disposed upon the top planar support top surface, orthogonally oriented in relation to the opposing longitudinal peripheral edges.

15. The rifle telescope mounting device of claim 11, wherein a first pair of the legs are disposed at a back end of the top planar support and a second pair of the legs are disposed proximal to a middle portion of the top planar support, such that the second pair of legs are more proximal to a front end of the top planar support than the back end thereof.

16. The rifle telescope mounting device of claim 11, wherein the device is reversible upon the weapon receiver.

17. The rifle telescope mounting device of claim 11, wherein the rifle is chosen from the group consisting of Heckler and Koch models HK31, HK33, HK51, HK53, HK91, HK93, HK95, MP5 and G3.

* * * * *